US007604233B2

(12) United States Patent
Nakazawa et al.

(10) Patent No.: US 7,604,233 B2
(45) Date of Patent: Oct. 20, 2009

(54) MOVABLE PAPER GUIDE OF IMAGE FORMING APPARATUS

(75) Inventors: Shinji Nakazawa, Kyoto (JP); Yoshiharu Yoneda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 174 days.

(21) Appl. No.: 11/808,078

(22) Filed: Jun. 6, 2007

(65) Prior Publication Data

US 2007/0284811 A1 Dec. 13, 2007

(30) Foreign Application Priority Data

Jun. 7, 2006 (JP) ..... 2006-158797

(51) Int. Cl.
*B65H 9/04* (2006.01)
*B65H 5/00* (2006.01)

(52) U.S. Cl. ..... 271/242; 271/264

(58) Field of Classification Search ..... 271/242, 271/264

See application file for complete search history.

(56) References Cited

U.S. PATENT DOCUMENTS

| | | | | |
|---|---|---|---|---|
| 5,713,570 | A * | 2/1998 | Ouchi | 271/242 |
| 6,974,128 | B2 * | 12/2005 | Quesnel | 271/227 |
| 7,128,318 | B2 * | 10/2006 | Loiselle | 271/245 |

FOREIGN PATENT DOCUMENTS

| | | | |
|---|---|---|---|
| JP | 7-267427 | A | 10/1995 |
| JP | 11-79468 | A | 3/1999 |
| JP | 2003-276900 | A | 10/2003 |
| JP | 2005-82355 | A | 3/2005 |

* cited by examiner

*Primary Examiner*—David H Bollinger
(74) *Attorney, Agent, or Firm*—Birch, Stewart, Kolasch & Birch, LLP

(57) ABSTRACT

A guide member, which is constituted by an upper paper guide and a lower paper guide that form a paper transport path, is arranged between registration rollers and pre-registration rollers. At least one of the upper paper guide and the lower paper guide is supported swingably during printing operation.

15 Claims, 11 Drawing Sheets

MOVABLE PAPER GUIDE OF IMAGE FORMING APPARATUS

This application claims priority under 35 U.S.C. § 119(a) on Patent Application No. 2006-158797 filed in Japan on Jun. 7, 2006, the entire contents of which are hereby incorporated by reference.

BACKGROUND OF THE INVENTION

The present invention relates to a paper guide, which is arranged on an upstream side of an electrostatic latent image carrier and forms a paper transport path between registration rollers and pre-registration rollers.

For reasons related to installation space, mainstream image forming apparatuses of recent years have been of a space-saving vertical carrying type. That is, these are structured such that a plurality of paper supply cassettes are arranged stacked in a lower portion of the apparatus main unit and a transfer portion and a fixing portion are arranged in an upper portion thereof. In these structures, a carried sheet that has been supplied from the paper supply cassette is initially carried upward then carried toward the transfer portion after being changed to horizontal direction carrying by being bent substantially 90 degrees before the transfer portion.

FIG. 9A shows a configuration of the paper transport path on a front side of the transfer portion.

Pairs of carry rollers R31 and R32, pre-registration rollers R41 and R42, and registration rollers R51 and R52 are arranged in order along a sheet carry direction S of a paper transport path 28, which is arranged in a bent shape as mentioned above, and the registration rollers R51 and R52 are provided facing a nip portion N5 with a distance of approximately 50 mm, the nip portion N5 being a contact portion between an electrostatic latent image carrier (photosensitive drum) 14 and a transfer roller 17*a*. Furthermore, a guide member 80, which is constituted by an upper paper guide 81 and a lower paper guide 82 and forms the paper transport path, is fixedly arranged having a constant interval and in a slightly upwardly bent state between the registration rollers R51 and R52 and the pre-registration rollers R41 and R42. That is, as shown in FIG. 11, the upper paper guide 81 and the lower paper guide 82 are structured such that both their end portions are fastened by screws 98 or the like.

FIG. 10 is a chart showing an operation timing of the registration rollers R51 and R52 and the pre-registration rollers R41 and R42.

Namely, when paper P is carried on the paper transport path 28 until the registration rollers R51 and R52 and the paper leading edge contacts (is sandwiched by) a nip portion N5 of the registration rollers R51 and R52, the registration rollers R51 and R52 first stop at a time t1 then at a slightly subsequent time t2, the pre-registration rollers R41 and R42 stop. Due to stopping with this time gap, the paper P that is sandwiched by the registration rollers R51 and R52 and the pre-registration rollers R41 and R42 is held in a flexed state in a slightly bent form as shown in FIG. 9A. At this time, as shown in FIG. 9B, variation in a run-out amount L1 of the paper P from the nip portion N5 of the registration rollers R51 and R52 occurs due to such factors as the paper size, thickness, paper strength, and the balance of pressing force between the registration rollers R51 and R52.

After this, the registration rollers R51 and R52 and the pre-registration rollers R41 and R42 again commence carrying of the paper P at a time t3, which is a timing that enables the leading edge of the paper P and the leading edge of image information that is developed on the electrostatic latent image carrier (photosensitive drum) 14 to correspond. By causing the paper P to be flexed slightly at this time, the feed timing for the leading edge of the paper P from the registration rollers R51 and R52 can be made consistent along the width direction of the paper, thereby preventing slanted carrying of the paper P and eliminating width direction deformation of the image to be formed on the paper P. That is, the paper P that is temporarily stopped by the registration rollers R51 and R52 undergoes during the stoppage fine adjustments of leading edge positions in the direction parallel to the paper transport direction S, center alignment of the carried paper, and correction of slanted carrying at the time of carrying by the registration rollers R51 and R52.

At this time, when the paper P is subjected to slanted carrying, amounts of flexure of the paper P vary at the left and right edges of the paper P orthogonal to the carrying direction S. In an example shown in FIG. 12 (FIG. 12A and FIG. 12B), a flexure amount A (see FIG. 12A) of the paper P is large on an back side of the paper transport direction (the right side when viewing the paper transport direction from the upstream side to the downstream side) and a flexure amount B (see FIG. 12B) of the paper P is small on a front side of the paper transport direction (the left side when viewing the paper transport direction from the upstream side to the downstream side). In this manner, due to the paper P being subjected to slanted carrying, a portion where the paper P makes contact with the paper guide arranged at a fixed spacing as well as a portion where the paper P does not make contact are produced on the paper P.

It should be noted that JP 2003-276900A also gives description in regard to a paper guide structure. A buffer mechanism portion that is constituted by an elastic force producing member, which is swingable and capable of absorbing slack and tension of the paper, and a paper guide is provided in the above-mentioned JP 2003-276900A, and it is described that in this buffer mechanism portion there is a structure provided with the elastic force generating member for absorbing slack and tension of the paper and an oscillation suppressing spring for achieving oscillation suppression that acts in an opposite direction, and the paper guide carries out a rotation movement centered on a shaft.

Incidentally, when the paper guide is fixedly arranged with a fixed spacing as mentioned above, a considerable load is exerted on the contact area due to the flexure amount of the paper in regard to the area where the paper makes contact with the paper guide due to the flexure caused by slanted carrying. For this reason there is a likelihood that problems such as the following will occur.

Namely, (1) the paper will be subjected to frictional electrification such that an uneven frictional electrification electric potential is produced in a single paper. (2) Paper dust will be generated from the paper due to abrasion at the contact area. (3) Correction of slanted carrying will not be able to be carried out correctly due to increased local loads from the paper guide. (4) Wrinkling or the like will occur due to twisting of the paper by slanted carrying.

These problems are causes of reduced printing quality in subsequent processing of the carried paper and deterioration of consumables (the photosensitive body, developer and the like).

The present invention has been devised to address these problems and it is an object thereof to provide a movable paper guide of an image forming apparatus that eliminates the various above-described problems that occur due to the rubbing between the paper guide and the paper, by allowing one of the upper and lower paper guides arranged between the registration rollers and the pre-registration rollers to have a movable structure capable of absorbing "paper flexure" that is produced to correct slanted carrying of the carried paper.

SUMMARY OF THE INVENTION

In order to address the above-described issues, a movable paper guide according to the present invention is provided in an image forming apparatus, in which registration rollers and pre-registration rollers are arranged on an upstream side of an electrostatic latent image carrier, and after a leading edge of carried paper contacts the registration rollers and the paper is caused to temporarily stop in a state in which a trailing edge side is sandwiched by the pre-registration rollers, carrying of the paper recommences with a timing enabling a leading edge of image information that has been developed on the electrostatic latent image carrier and a leading edge of the paper that has been stopped by the registration rollers to correspond, wherein a guide member, which is constituted by an upper paper guide and a lower paper guide that form a paper transport path, is arranged between the registration rollers and the pre-registration rollers, and at least one of the upper paper guide and the lower paper guide is supported swingably during printing operation.

With the movable paper guide of the present invention, by using a movable structure for one of the upper and lower paper guides arranged between the registration rollers and the pre-registration rollers which is capable of absorbing the "paper flexure" that is produced to correct slanted carrying of the carried paper, it is possible to prevent uneven frictional electrification electric potential in the paper produced by abrasion between the paper guide and the paper, as well as paper dust precipitation from the paper and inaccurate correction of slanted carrying, and as a result it is also possible to prevent reduced printing quality in subsequent processing of the carried paper and deterioration of consumables (the photosensitive body, developer and the like).

Specifically, the upper paper guide may be supported swingably by having a substantially central area of the upper paper guide supported by a hanging member on a device frame. In this case, considering that the paper guide is formed in a bent shape and is not arranged horizontally but rather arranged such that its registration rollers side is positioned slightly above its pre-registration rollers side, that is, arranged at a slight inclination, the substantially central area of the upper paper guide may be set so as to be in a position in which the upper paper guide maintains a balanced state. That is, this is not necessarily the centroid position of the upper paper guide, but is at least an arbitrary position of a vertical direction position passing through the centroid position.

Furthermore, the hanging member can be a single cord member constituted by a wire or the like or an elastic member. Coil springs are preferable as the elastic members. By using an elastic member such as this for the hanging members, the upper paper guide not only swings on the fulcrum of the fastening locations to the hanging members, but the entirety thereof moves so as to rise slightly depending on the paper strength, and therefore there is an effect by which the contact pressure between the paper and the upper paper guide is further reduced.

Furthermore, for the device frame by which the upper end portion of the hanging member is supported (fastened), the developing unit is arranged above the upper paper guide and a guide rail is provided for when the development tank is loaded into the developing unit, and therefore this guide rail may be used as the device frame.

On the other hand, when the upper paper guide is swingably provided as in the present invention, a gap between the lower paper guide, which is fixedly arranged, and the upper paper guide, which is swingable, specifically a gap between the front end portion and the trailing end portion of the paper transport direction, is subjected to variation, and in some cases there is a possibility that the trailing end portion of the upper paper guide will make contact with the trailing end portion of the lower paper guide opposed thereto. Then, when both end portions make contact with each other in this manner, there is a possibility that the paper supplied from the paper supply unit may not be carried smoothly between the upper paper guide and the lower paper guide (between the paper guides), such that a jam occurs. Consequently, in the present invention, stopper members for ensuring that the distance between the paper guides does not become less than a predetermined distance may be provided at the corner portions of the upper paper guide or the lower paper guide. That is, the predetermined distance may be set to a distance through which at least a leading edge of paper to be carried can pass smoothly. In this way, even when the opening between the paper guides narrows due to oscillation of the upper paper guide, an opening (distance) through which the paper can pass smoothly is reliably maintained.

DESCRIPTION OF THE PREFERRED EMBODIMENTS

Hereinafter, an embodiment of a movable paper guide in an image forming apparatus of the present invention is described with reference to the accompanying drawings.

Figure 1:
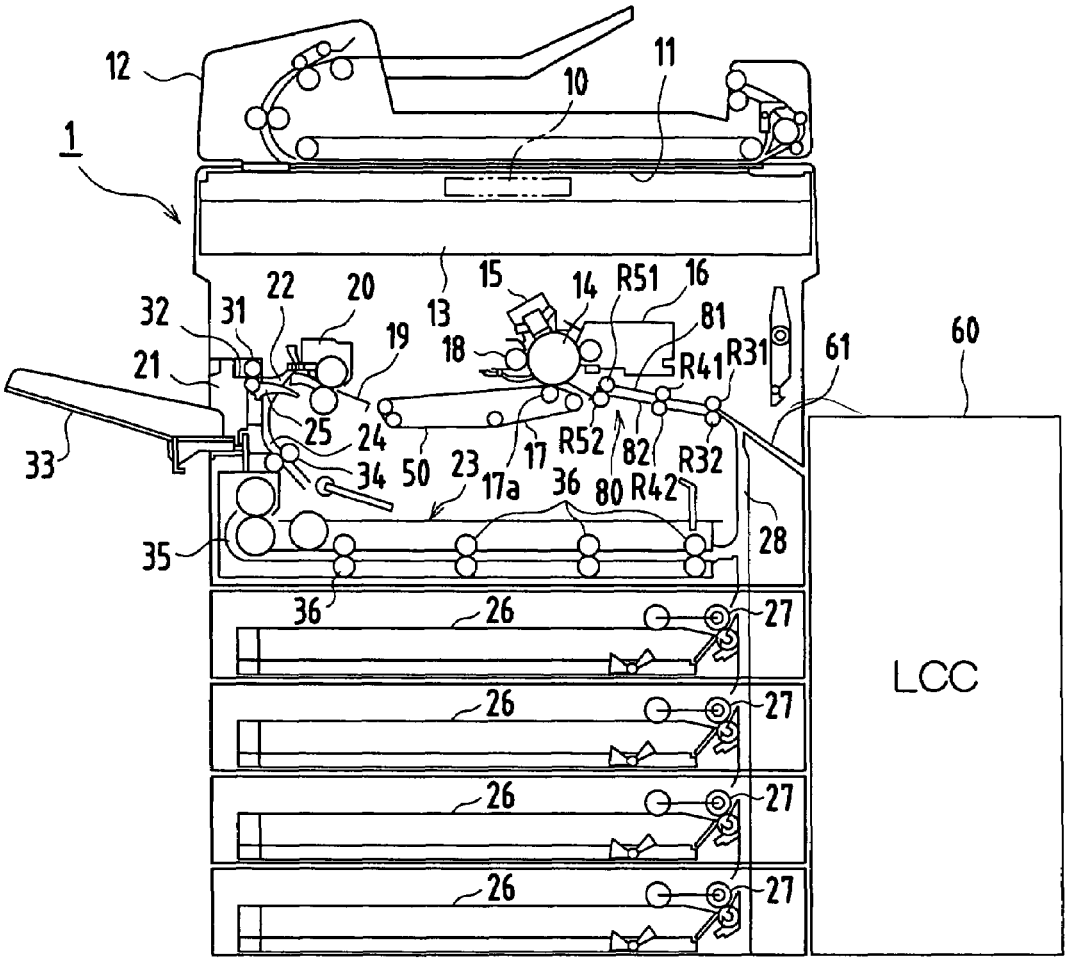
FIG. 1 is a side view showing an entire configuration of an image forming apparatus according to the present invention.

FIG. 1 is a side view showing an entire configuration of an image forming apparatus in which a movable paper guide according to the present embodiment is installed.

An image forming apparatus 1 according to the present embodiment is a digital image forming apparatus for example having various modes such as copying, printing, scanning, and faxing, and is provided with an operation panel 10 on a front surface side.

A hard, transparent glass material platen 11 is arranged on an upper surface of the image forming apparatus 1 and an automatic document feeding device 12 is arranged above the platen 11 while an optical unit 13 is arranged below the platen 11.

A photosensitive drum 14 whose surface is constituted by a photoconductive material is rotatably supported below the optical unit 13. Around the photosensitive drum 14 and arranged in a state facing a circumferential surface of the photosensitive drum 14 are a charging device 15, a developing device 16, a transfer unit 17, and a cleaner 18.

When instruction is given for commencement of an image formation process by operation of the operation panel 10 in the above-structured image forming apparatus 1, the optical unit 13 scans an image surface of the document placed on the platen 11, and reflected light from the document image surface of light from a copy lamp in the optical unit 13 is irradiated onto a surface of the photosensitive drum 14.

Prior to being irradiated by reflected light from the document, the surface of the photosensitive drum 14 is charged by the charging device 15 so as to have a uniform electric charge of a single polarity, and due to a photoconductive effect of the irradiation of reflected light from the document, an electrostatic latent image is formed on the surface of the photosensitive drum 14. Developer is supplied from the developing device 16 to the surface of the photosensitive drum 14 on which an electrostatic latent image is formed, and the electrostatic latent image is developed into a development image.

On the downstream side of the photosensitive drum 14 is arranged a fixing unit 20 constituted by a heating roller and a pressure roller. A transfer belt 50 of the transfer unit 17 and a paper guide 19 are arranged between the fixing unit 20 and the photosensitive drum 14, and a paper transport path is formed from the photosensitive drum 14 to the fixing unit 20 by the transfer belt 50 and the paper guide 19.

A discharge tray 33 is provided on a lateral surface of the image forming apparatus 1 and a discharge carry path 22 is formed between the fixing unit 20 and the discharge tray 33. A portion of the discharge carry path 22 is diverted via a diverting gate 25 to a re-carry path 24 that is linked to an automatic double-side paper supply device 23 arranged below the photosensitive drum 14.

Figure 9A:
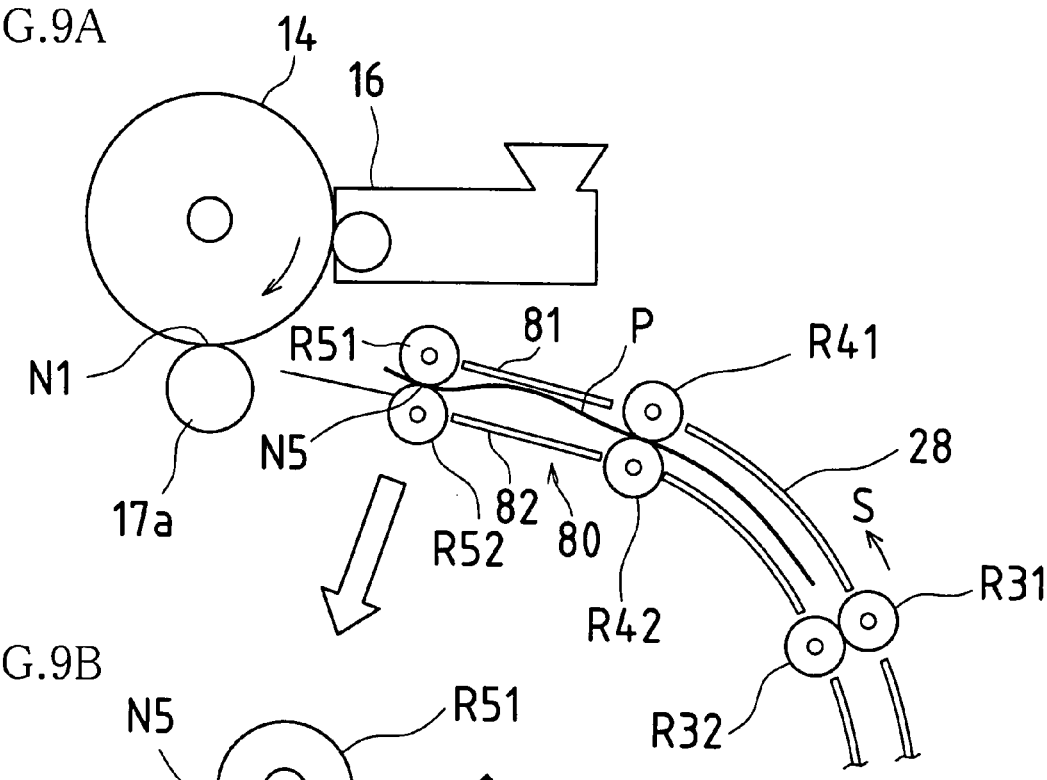
FIG. 9A is an explanatory diagram showing a configuration of a paper transport path on a front side of a transfer portion.
Figure 9B:
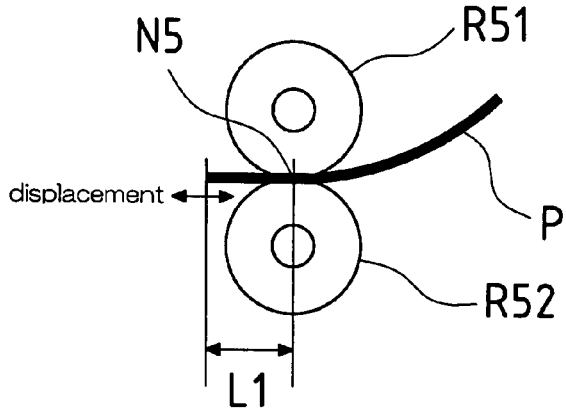
FIG. 9B is an explanatory diagram showing an enlargement of a registration roller area.
Figure 10:
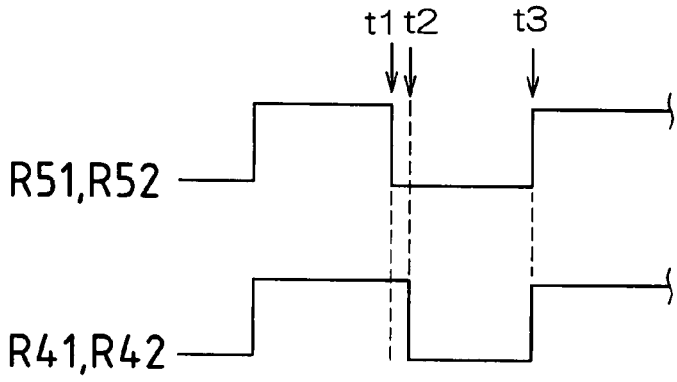
FIG. 10 is a chart showing an operation timing of registration rollers and pre-registration rollers.
Figure 11:
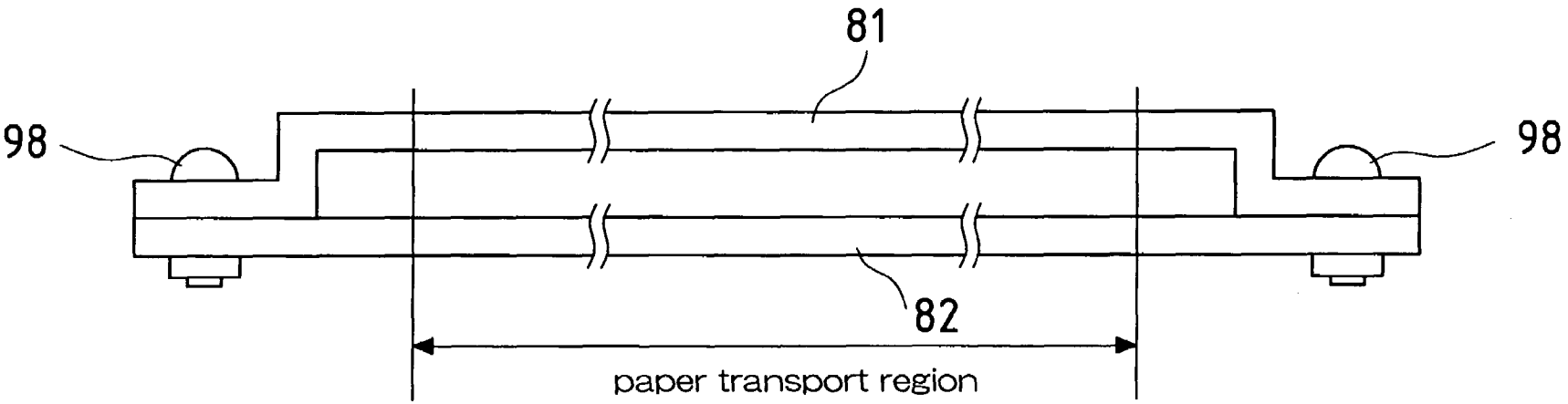
FIG. 11 is an explanatory diagram showing a fastening structure of the registration rollers and the pre-registration rollers as viewed from the paper transport direction.
Figure 12A:
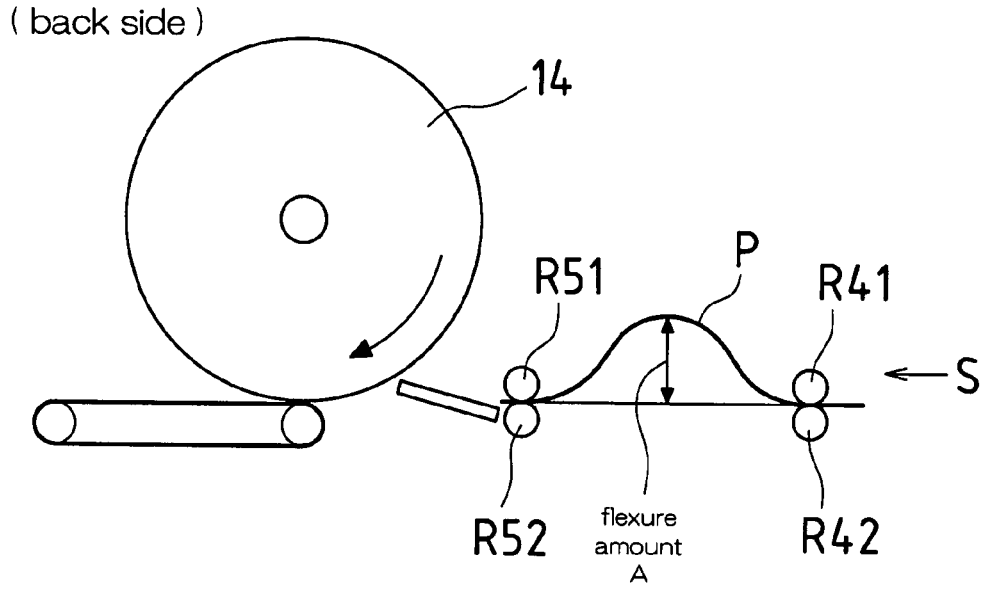
FIG. 12A and FIG. 12B are explanatory diagrams showing a difference in flexure amounts in a direction orthogonal to the paper transport direction due to slanted carrying of the paper.
Figure 12B:
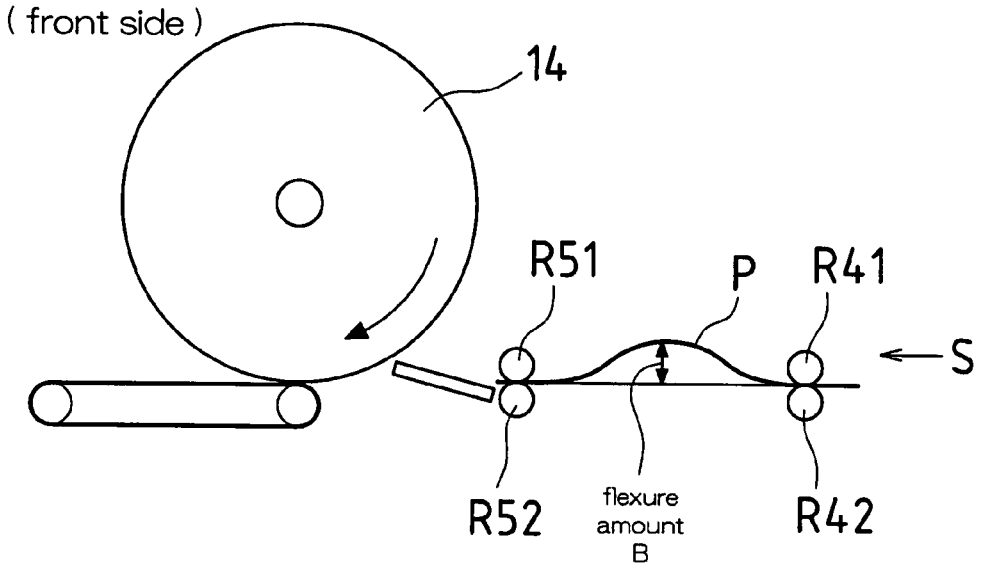

Four paper supply cassettes 26 that are detachably loaded from the front surface side of the image forming apparatus 1 are provided in a lower portion of the image forming apparatus 1. Each of the paper supply cassettes 26 contains paper of a different size and prior to rotation of the photosensitive drum 14, paper from one paper supply cassette 26 of the four paper supply cassettes 26 is supplied via a paper supply roller 27. Paper that has been supplied is carried toward the photosensitive drum 14 by the carry rollers R31 and R32 via a shared carry path 28, then its trailing edge is sandwiched by the pre-registration rollers R41 and R42 and its front edge makes contacts and stops at the registration rollers R51 and R52. A guide member 80, which is constituted by an upper paper guide 81 and a lower paper guide 82 and forms the paper transport path, is arranged between the registration rollers R51 and R52 and the pre-registration rollers R41 and R42. The fundamental structure of this area is the same as the structure shown in FIG. 9, but unlike conventional techniques, the upper paper guide 81 is movable in the present invention. This point is described in detail later. Furthermore, the operation timing of the registration rollers R51 and R52 and the pre-registration rollers R41 and R42 is also the same operation timing as shown in FIG. 10.

Furthermore, the image forming apparatus 1 of the present embodiment is provided with a large capacity paper supply unit (LCC) 60. Details of the structure of the large capacity paper supply unit 60 are omitted here, but paper supplied from the large capacity paper supply unit 60 is carried toward the photosensitive drum 14 by the carry rollers R31 and R32 via a unit-side carry path 61 that merges with the shared carry path 28 before the carry rollers R31 and R32, then its trailing edge is sandwiched by the pre-registration rollers R41 and R42 and its front edge makes contacts and stops at the registration rollers R51 and R52.

Figure 2A:
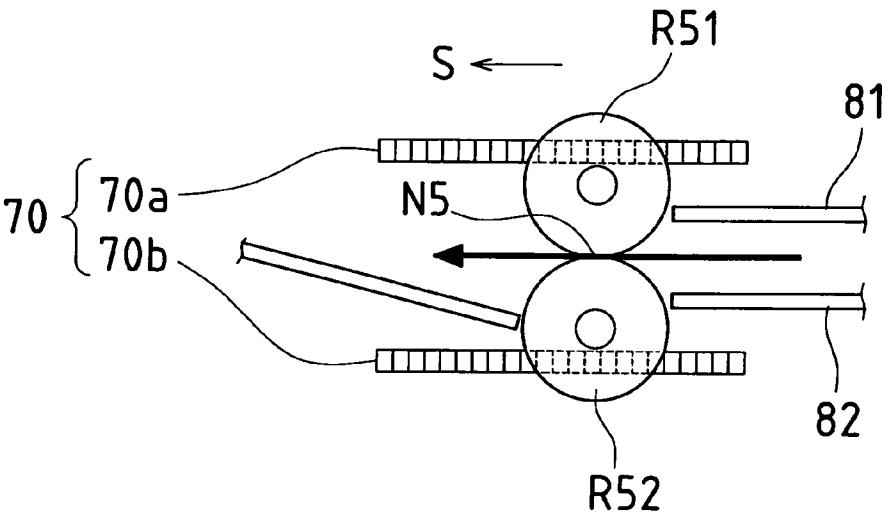
FIG. 2A is a side view of a paper leading edge detection means.

The registration rollers R51 and R52 rotate in synchronization with the rotation of the photosensitive drum 14 and introduce the paper to a nip portion (image formation region) N5 between the photosensitive drum 14 and the transfer unit 17 (see FIG. 2A). The paper that has been introduced to the image formation region receives a corona discharge of the transfer unit 17 and the development image held on the surface of the photosensitive drum 14 is transferred to a surface of the paper.

The paper onto which the development image has been transferred is carried to the fixing unit 20 along the transfer belt 50 and the paper guide 19 and subjected to heat and pressure by the fixing unit 20 such that the development image is fused and fixed onto the surface of the paper.

In single sided printing mode in which an image is printed on a single side of the paper, the paper that has passed through the fixing unit 20 is discharged from a discharge outlet 32 by a discharge roller 31 via the discharge carry path 22 onto the discharge tray 33. At this time, the discharge roller 31 is driven backward and forward along the paper transport direction by a discharge roller drive portion not shown in the drawing.

In double sided printing mode in which images are printed on both sides of the paper, the diverting gate 25 becomes exposed to a portion of the discharge carry path 22 and the paper that has passed through the fixing unit 20 is carried to the automatic double-side paper supply device 23 via the re-carry path 24, which is provided with a carry roller 34. The paper that has been carried to the automatic double-side paper supply device 23 is supplied in a state in which it has been inverted back to front by a re-supplying roller 35, and is again carried via the shared carry path 28 by a re-carrying roller 36 toward the photosensitive drum 14 in a state in which its front and reverse surfaces are inverted, then its trailing edge is sandwiched by the pre-registration rollers R41 and R42 and its front edge makes contacts and stops at the registration rollers R51 and R52.

Figure 2B:
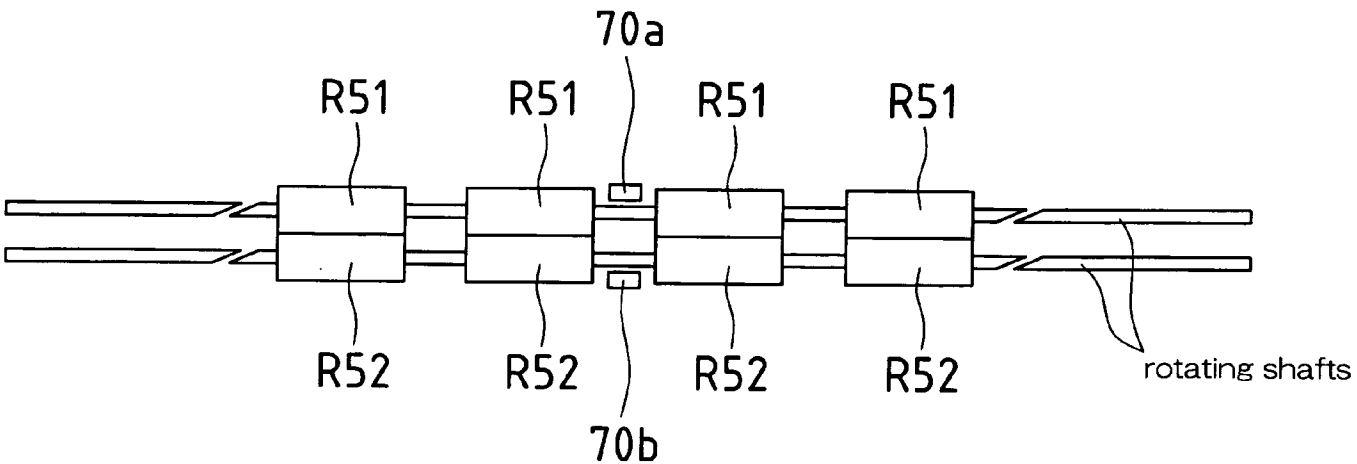
FIG. 2B is a plan view of the same.

FIG. 2A and FIG. 2B show a structural example of a paper leading edge detection means 70 that detects a leading edge stopping position of paper that has made contact and stopped at the registration rollers R51 and R52. As shown in FIG. 2B, the registration rollers R51 and R52 involve four pairs of registration rollers R51 and R52 arranged widthwise with predetermined spacings. A light emitting-side line sensor 70*a* and a light receiving-side line sensor 70*b* face each other above and below the paper transport path in a substantially central area widthwise of the registration rollers R51 and R52, and are arranged along the paper transport direction S that is orthogonal to the registration rollers R51 and R52. As shown in FIG. 2A, the line sensors 70*a* and 70*b* are arranged so as to be provided extending before and after (in the paper transport direction S) a nip portion N5 of the registration rollers R51 and R52, and in particular are arranged slightly longer on the photosensitive drum 14 side from the nip portion N5. It should be noted that the structure of the pre-registration rollers R41 and R42 is equivalent to the structure of the registration rollers R51 and R52 shown in FIG. 2B.

Figure 3:
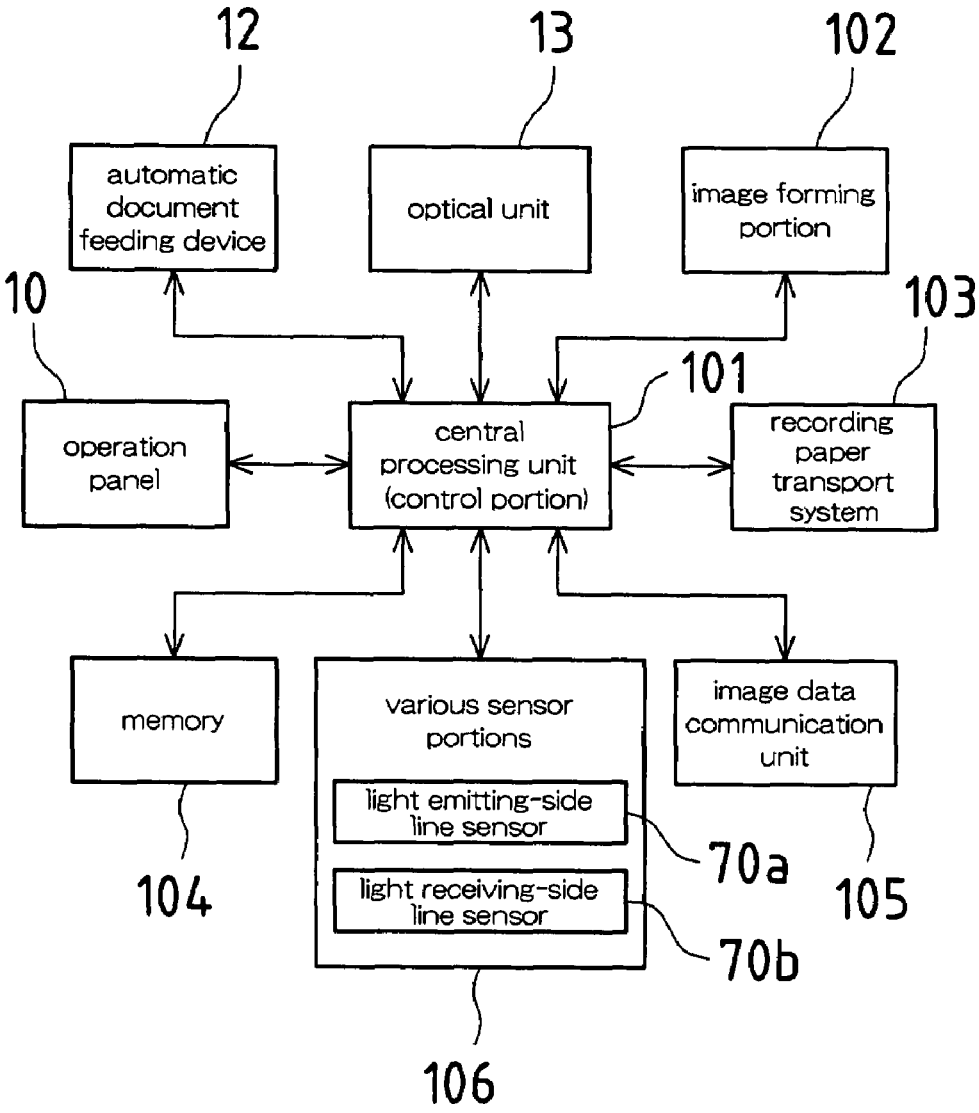
FIG. 3 is a block diagram showing a configuration of a control system of an image forming apparatus according to the present invention.

Next, a configuration of a control system in the image forming apparatus 1 of the above-described structure is described with reference to the block diagram shown in FIG. 3.

A central processing unit (control portion) 101 performs sequence control-based management of the various drive mechanism portions that constitute the image forming apparatus 1 such as the automatic document feeding device 12, the optical unit 13, an image forming portion 102, and a paper transport system 103, and outputs control signals to the various portions based on detection values of various sensor portions 106 including the above-mentioned paper leading edge detection means 70 (the light emitting-side line sensor 70*a* and the light receiving-side line sensor 70*b*).

The operation panel 10 is connected to the control portion 101 in a mutually communicable state, and the image forming apparatus 1 is able to be made to function in accordance with print processing conditions involving input of settings by the user based on operation of the operation panel 10.

Furthermore, a memory 104 and an image data communication unit 105 are connected to the control portion 101. The memory 104 stores various control information necessary in controlling the various drive mechanism portions that constitute the image forming apparatus 1. The image data communication unit 105 is a communication unit provided for enabling information communication of image information and image control signals and the like with other digital image devices. The control portion 101 carries out print processing control in accordance with print processing conditions that have been inputted and set by the user by operation of the operation panel 10.

Figure 4:
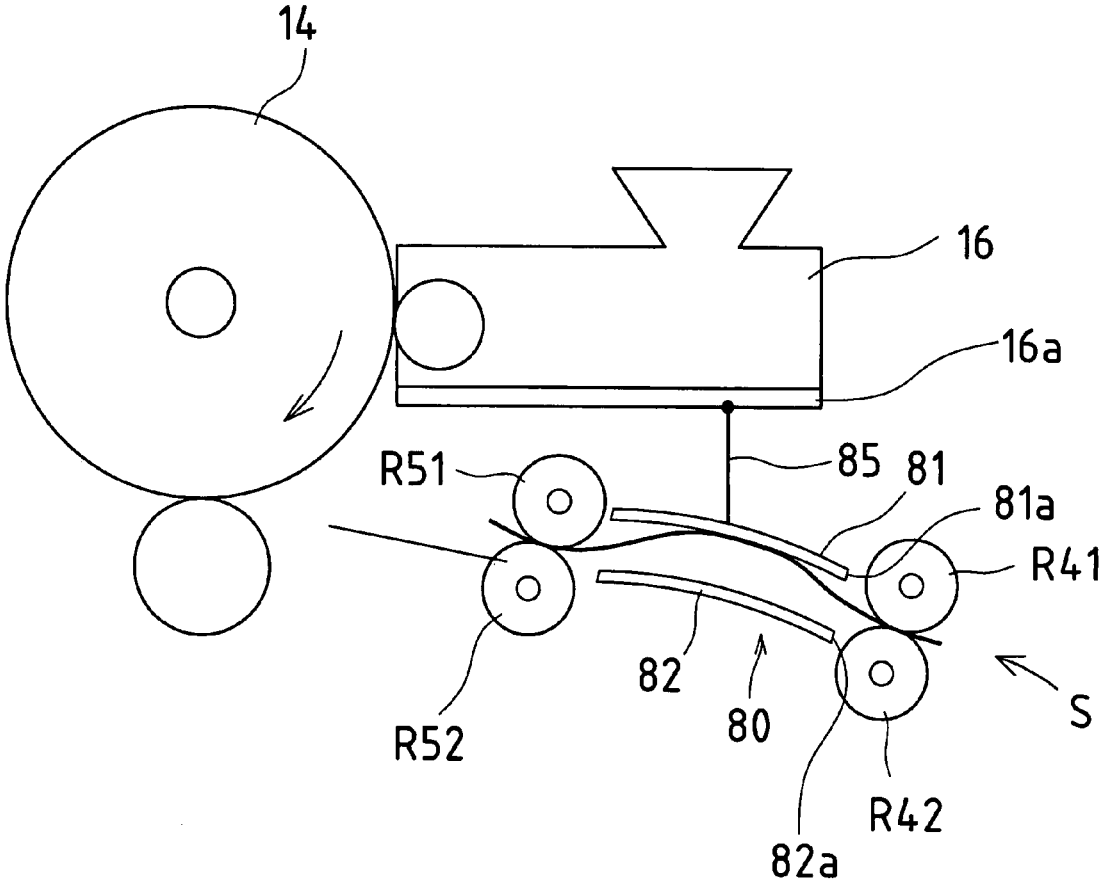
FIG. 4 is an outline explanatory diagram showing a configuration of a movable paper guide according to the present embodiment as viewed from a lateral surface.
Figure 5:
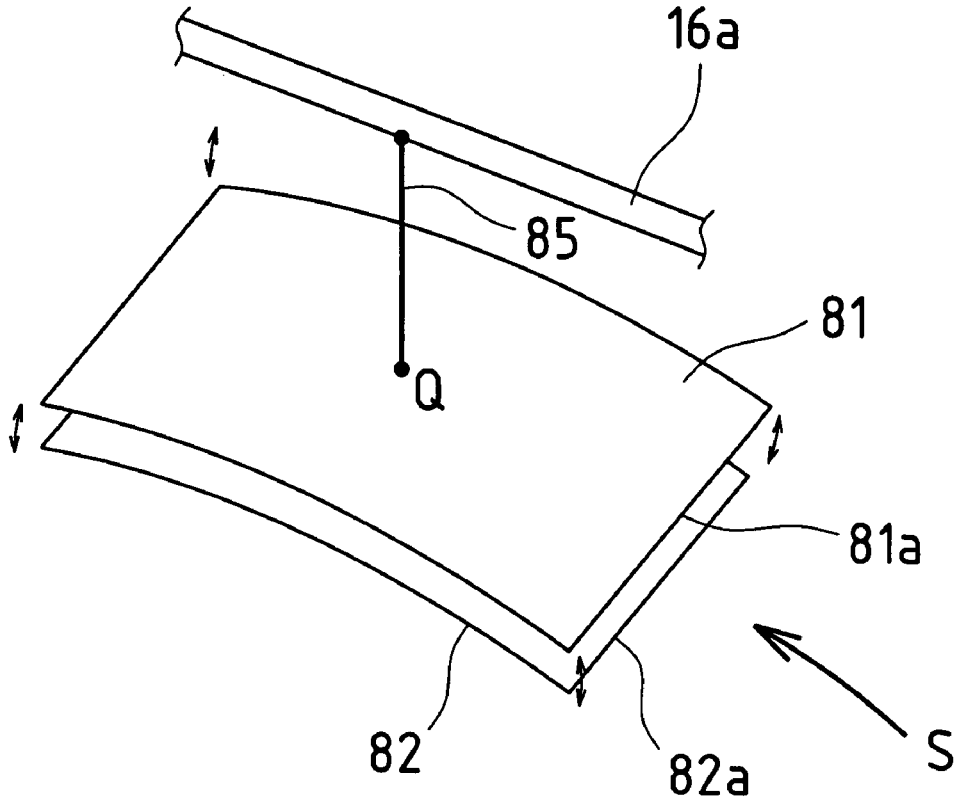
FIG. 5 is a perspective view showing a configuration of the movable paper guide according to the present embodiment.
Figure 6:
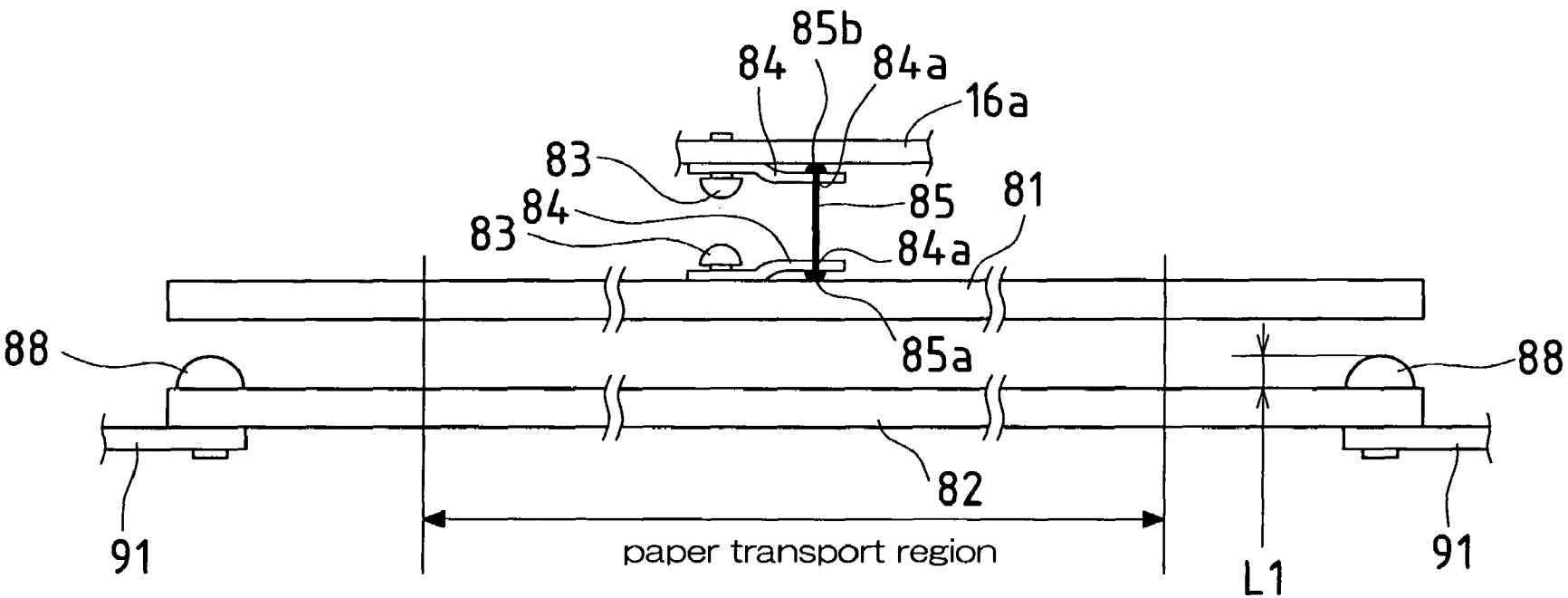
FIG. 6 is an explanatory diagram showing a configuration of the movable paper guide according to the present embodiment as viewed from a paper transport direction.

FIG. 4 to FIG. 6 show a configuration of a movable paper guide 80 according to the present embodiment, wherein FIG. 4 is an outline explanatory diagram as viewed from a lateral surface, FIG. 5 is a perspective view thereof, and FIG. 6 is a front view as viewed from the upstream side to the downstream side of the paper transport direction. In the present embodiment, the upper paper guide 81 is structured so as to be supported swingably (movably) during printing operations.

That is, the upper paper guide 81 and the lower paper guide 82 that form the paper transport path between the registration rollers R51 and R52 and the pre-registration rollers R41 and R42 are arranged in a slightly upwardly bent state and are arranged so as to maintain a predetermined upper-lower interval. Of these, the lower paper guide 82 is equivalent to components described in prior art and is fastened to a device frame 91 or the like.

On the other hand, a substantially central area (fulcrum) Q of the upper surface of the upper paper guide 81 is supported on the device frame or the like by a single hanging member 85. That is, a lower end portion of the hanging member 85, which is constituted by a wire or the like, is fastened to the substantially central area Q on the upper surface of the upper paper guide 81 and an upper end portion of the hanging member 85 is fastened to the device frame or the like. In regard to the device frame to which the upper end portion of the hanging member 85 is fastened here, the developing device 16 is arranged above the upper paper guide 81, with a guide rail 16*a* provided for when a development tank not shown in the drawing is loaded into or unloaded from the developing device 16, and in the present embodiment this guide rail 16*a* is used as the device frame. That is, the upper end portion of the hanging member 85 is fastened to the guide rail 16*a*.

As a fastening structure, a fastening piece 84 is attached to the upper surface central area of the upper paper guide 81 by a screw 83 or the like as shown in FIG. 6 for example, and a bulging portion 85*a* formed at the lower end portion of the hanging member 85 fits to an opening 84*a* formed in the fastening piece 84 (or a slit portion not shown in the drawing that is formed from the end portion). Similarly, a fastening piece 84 is attached to the guide rail 16*a* by a screw 83 or the like, and a bulging portion 85*b* formed at the upper end portion of the hanging member 85 fits to an opening 84*a* formed in the fastening piece 84 (or a slit portion not shown in the drawing that is formed from the end portion). However, there is no limitation to this fastening structure.

In this case, considering that the upper paper guide 81 is formed in a bent shape and, as shown in FIG. 4, is not arranged horizontally but rather is arranged such that its registration rollers R51 and R52 side is positioned slightly above its preregistration rollers R41 and R42 side (that is, arranged at a slight inclination), the substantially central area Q of the upper paper guide 81 is set so as to be in a position in which the upper paper guide 81 maintains a balanced state. That is, it is a vertical direction position passing through the centroid position of the upper paper guide.

By arranging the upper paper guide 81 swingably (movably) in this manner, when the flexed paper contacts the upper paper guide 81, the upper paper guide 81 swings (moves) with the upper surface substantially central area Q as its fulcrum so as to reduce the contact pressure.

Furthermore, rather than being a rigid member such as a wire, an elastic member such as a rubber material or a coil spring may be used as the hanging member 85. When an elastic member such as this is used as the hanging member 85, rather than the upper paper guide 81 merely oscillating when the flexed paper makes contact, a contractile force of the elastic member acts and the entirety moves so as to rise slightly. This makes it possible to further reduce the contact pressure at the contact area between the paper and the upper paper guide 81.

On the other hand, when the upper paper guide 81 is swingably provided as in the present embodiment, a gap between the lower paper guide 82, which is fixedly arranged, and the upper paper guide 81, which is swingable, particularly a gap interval between the front end portion and the trailing end portion of the paper transport direction S, is subjected to variation, and in some cases there is a possibility that a trailing end portion 81*a* for example of the upper paper guide 81 makes contact with (or approaches) a trailing end portion 82*a* of the lower paper guide 82 opposed thereto. Then, when both end portions 81*a* and 82*a* contact (or approach) each other in this manner, there is a possibility that the paper supplied from the paper supply cassette 26 may not be smoothly carried between the paper guides 81 and 82 (between the upper paper guide 81 and the lower paper guide 82) such that a jam occurs.

Accordingly, in the present embodiment, stopper members 88 for ensuring that the distance between the paper guides 81 and 82 does not become below a predetermined distance L1 (for example, 0.5 mm) are provided at four corner portions of the lower paper guide 82 as shown in FIG. 6. That is, the predetermined distance L1 is set at a distance at which at least the leading edge of the paper to be carried can pass smoothly between the upper paper guide 81 and the lower paper guide 82. In this way, even when the opening between the paper guides 81 and 82 narrows due to oscillation of the upper paper guide 81, an opening (distance) through which the paper can pass smoothly is reliably maintained. In the present embodiment, the stopper members 88 are the screws for fastening the lower paper guide 82 to the device frame 91 or the like, which are structured using a thickness of a head portion of the screws to maintain the predetermined distance L1.

Figure 7A:
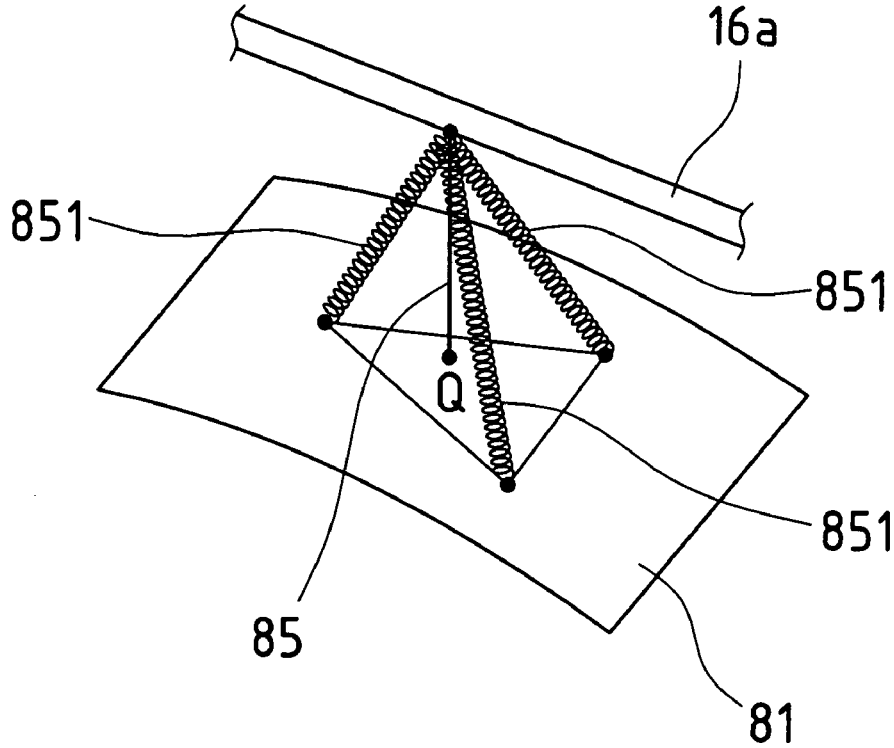
FIG. 7A and FIG. 7B include perspective views showing other embodiments of the movable paper guide.
Figure 7B:
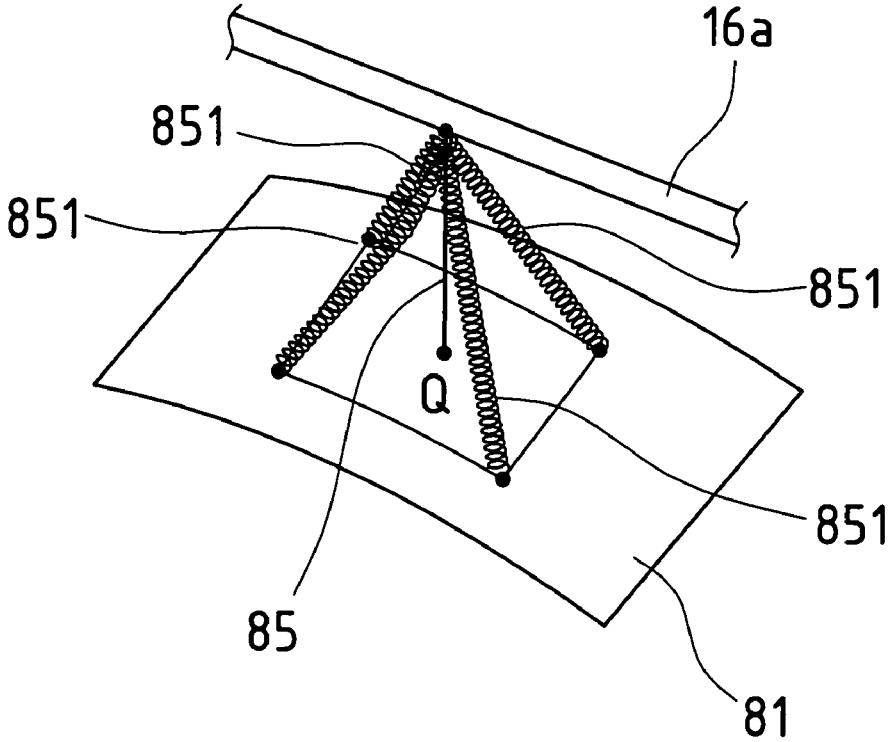

FIG. 7 (FIG. 7A and FIG. 7B) shows other embodiments of the movable paper guide.

That is, in the structures shown in FIG. 4 to FIG. 6, the hanging structure is one in which the upper paper guide 81 is supported by only a single hanging member 85, but the upper paper guide 81 is prone to instability with this structure. Consequently, in the embodiments shown in FIG. 7, three or four elastic members 851 are arranged around the hanging member 85 having rigidity such as a wire. When the arranged structure is of three members, upper end portions of the three elastic members 851 are fastened respectively to the same location as the fastening location on the guide rail 16*a* where the upper end portion of the hanging member 85 is fastened as shown in FIG. 7A, and each lower end portion is fastened respectively in positions of apexes forming an equilateral triangle or an isosceles triangle having a centroid set to a substantially central area (fulcrum) Q of the upper paper guide 81. Furthermore, when the arranged structure is of four members, upper end portions of the four elastic members 851 are fastened respectively to the same location as the fastening location on the guide rail 16*a* where the upper end portion of the hanging member 85 is fastened as shown in FIG. 7B, and each lower end portion is fastened respectively in positions of apexes forming a square or a rectangle having a centroid set to a substantially central area (fulcrum) Q of the upper paper guide 81.

By using a hanging structure such as this, the upper paper guide 81 can be held in a more stable state and an oscillating action can be supported flexibly.

Figure 8A:
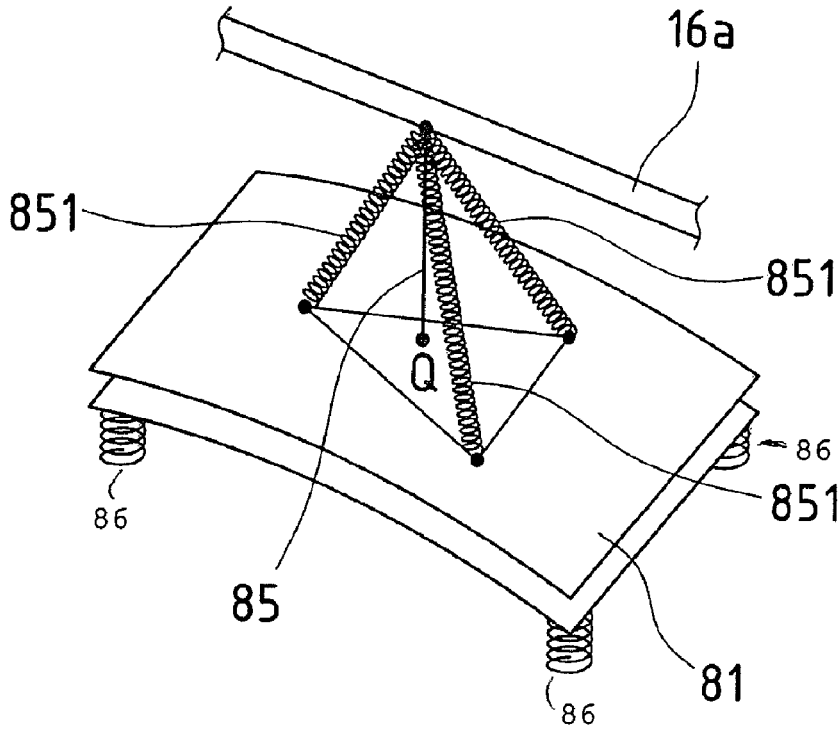
FIG. 8A and FIG. 8B include perspective views showing other embodiments of the movable paper guide.
Figure 8B:
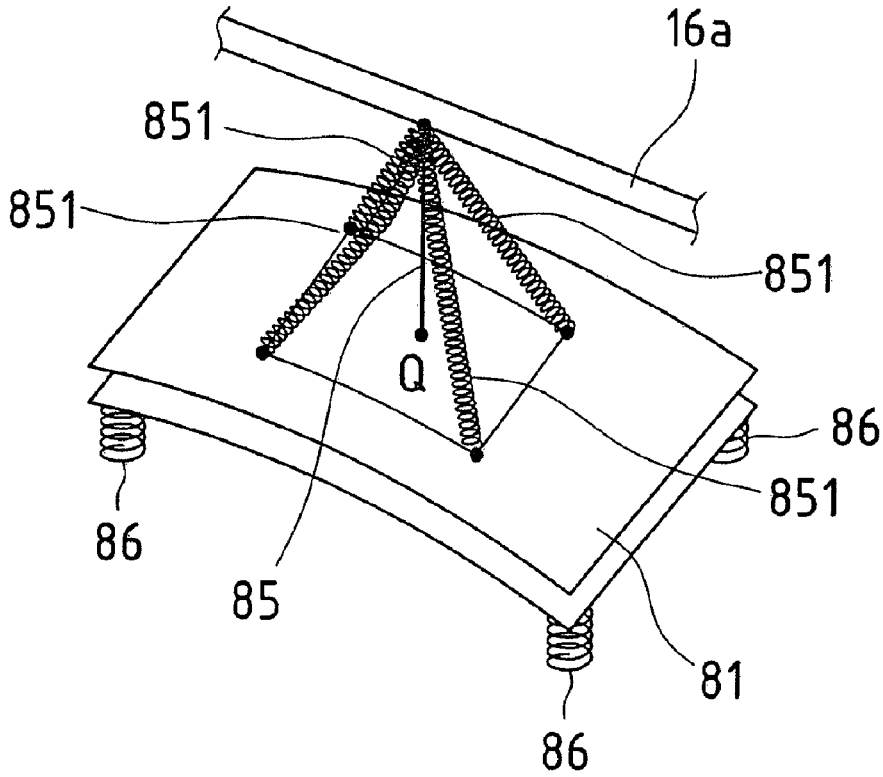

It should be noted that a structure in which the upper paper guide 81 is supported swingably during printing operations was shown in the above-described embodiments, but there is no limitation to this as long as at least one of the upper paper guide 81 and the lower paper guide 82 is supported swingably during printing operations. Specifically, as shown in FIG. 8 (FIG. 8A and FIG. 8B), a configuration in which not only the upper paper guide 81 but also the lower paper guide 82 is supported swingably during printing operations may be used.

In the embodiments shown in FIG. 8, the upper paper guide 81 is constituted by the structure shown in FIG. 7 and detailed description thereof is omitted here. The lower paper guide 82 is constituted by a structure in which elastic members 86 such as a rubber material or coil springs are arranged in the four corner portions thereof respectively, and one end of each of the elastic members 86 is fastened underneath the four corners of the lower paper guide 82 and the other end of each of the elastic member 86 is fastened to a structural member in the vicinity of the lower paper guide 82 of the image forming apparatus 1 (for example, the casing or the like of the image forming apparatus 1). By arranging the lower paper guide 82 swingably in this manner, when the flexed paper contacts the lower paper guide 82, a contractile force of the elastic members 86 acts so as to reduce the contact pressure thereof, and the entire lower paper guide 82 is lowered slightly such that the lower paper guide 82 swings.

It is preferable to swingably arrange not only the upper paper guide 81 but also the lower paper guide 82 as described above so that the opening (distance) through which the paper can pass smoothly is reliably maintained.

In the above-described FIG. 8, both of the upper paper guide 81 and the lower paper guide 82 are supported swingably during printing operations, but this is a preferable example and it is also possible to provide elastic members 86 only to the lower paper guide 82 without providing the hanging member 85 and the elastic member 851 to the upper paper guide 81 such that the lower paper guide 82 is supported swingably during printing operations.

The image forming apparatus of the present invention described above has modes for copying, printing, scanning, and faxing, and is suitably used in high-speed digital multifunction machines in which large volumes of printed materials undergo print processing at high speeds.

It should be noted that the present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A movable paper guide in an image forming apparatus, in which registration rollers and pre-registration rollers are arranged on an upstream side of an electrostatic latent image carrier, and after a leading edge of carried paper contacts the registration rollers and the paper is caused to temporarily stop in a state in which a trailing edge side is sandwiched by the pre-registration rollers, carrying of the paper recommences with a timing enabling a leading edge of image information that has been developed on the electrostatic latent image carrier and a leading edge of the paper that has been stopped by the registration rollers to correspond, wherein a guide member, which is constituted by an upper paper guide and a lower paper guide that form a paper transport path, is arranged between the registration rollers and the pre-registration rollers, the upper paper guide is supported swingably during printing operation by having substantially central area of the upper paper guide supported by a hanging member on a device frame, and the substantially central area of the upper paper guide is a position at which the upper paper guide maintains a balanced state.

2. The movable paper guide according to claim 1, wherein the hanging member is a cord member such as a wire or an elastic member.

3. The movable paper guide according to claim 1, wherein the device frame is a guide rail for when a development tank is loaded into a development unit arranged above the upper paper guide.

4. The movable paper guide according to claim 1, wherein a stopper member for ensuring that a distance between the upper paper guide and the lower paper guide does not become less than a predetermined distance is provided at a corner portion of the upper paper guide or the lower paper guide.

5. The movable paper guide according to claim 4, wherein the predetermined distance is a distance through which at least a leading edge of paper to be carried can pass smoothly.

6. A movable paper guide in an image forming apparatus, in which registration rollers and pre-registration rollers are arranged on an upstream side of an electrostatic latent image carrier, and after a leading edge of carried paper contacts the registration rollers and the paper is caused to temporarily stop in a state in which a trailing edge side is sandwiched by the pre-registration rollers, carrying of the paper recommences with a timing enabling a leading edge of image information that has been developed on the electrostatic latent image carrier and a leading edge of the paper that has been stopped by the registration rollers to correspond, wherein a guide member, which is constituted by an upper paper guide and a lower paper guide that form a paper transport path, is arranged between the registration rollers and the pre-registration rollers, the lower paper guide are supported swingably during printing operation, and elastic members are fastened underneath the lower paper guide.

7. The movable paper guide according to claim 6, wherein a stopper member for ensuring that a distance between the upper paper guide and the lower paper guide does not become less than a predetermined distance is provided at a corner portion of the upper paper guide or the lower paper guide.

8. The movable paper guide according to claim 7, wherein the predetermined distance is a distance through which at least a leading edge of paper to be carried can pass smoothly.

9. A movable paper guide in an image forming apparatus, in which registration rollers and pre-registration rollers are arranged on an upstream side of an electrostatic latent image carrier, and after a leading edge of carried paper contacts the registration rollers and the paper is caused to temporarily stop in a state in which a trailing edge side is sandwiched by the pre-registration rollers, carrying of the paper recommences with a timing enabling a leading edge of image information that has been developed on the electrostatic latent image carrier and a leading edge of the paper that has been stopped by the registration rollers to correspond, wherein a guide member, which is constituted by an upper paper guide and a lower paper guide that form a paper transport path, is arranged between the registration rollers and the pre-registration rollers, and the upper paper guide and the lower paper guide are supported swingably during printing operation.

10. The movable paper guide according to claim 9, wherein the upper paper guide is supported swingably by having a substantially central area of the upper paper guide supported by a hanging member on a device frame.

11. The movable paper guide according to claim 10, wherein the substantially central area of the upper paper guide is a position at which the upper paper guide maintains a balanced state.

12. The movable paper guide according to claim 10, wherein the hanging member is a cord member such as a wire or an elastic member.

13. The movable paper guide according to claim 10, wherein the device frame is a guide rail for when a development tank is loaded into a development unit arranged above the upper paper guide.

14. The movable paper guide according to claim 10, wherein a stopper member for ensuring that a distance between the upper paper guide and the lower paper guide does not become less than a predetermined distance is provided at a corner portion of the upper paper guide or the lower paper guide.

15. The movable paper guide according to claim 14, wherein the predetermined distance is a distance through which at least a leading edge of paper to be carried can pass smoothly.

* * * * *